US006918790B2

(12) United States Patent
Wan et al.

(10) Patent No.: US 6,918,790 B2
(45) Date of Patent: Jul. 19, 2005

(54) ELECTRICAL CONNECTOR HAVING PRINTED CIRCUIT BOARD MOUNTED THEREIN

(75) Inventors: Qin Wan, Kunsan (CN); Qisheng Zheng, Kunsan (CN); Hong Jun Wang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/903,124

(22) Filed: Jul. 29, 2004

(65) Prior Publication Data

US 2005/0026502 A1 Feb. 3, 2005

(30) Foreign Application Priority Data

Jul. 29, 2003 (CN) ..... 03259974 U

(51) Int. Cl.[7] ..... H01R 13/66
(52) U.S. Cl. ..... 439/620
(58) Field of Search ..... 439/620, 676, 439/607

(56) References Cited

U.S. PATENT DOCUMENTS 5,069,641 A 12/1991 Sakamoto et al.
5,687,233 A * 11/1997 Loudermilk et al. ..... 439/620
6,287,147 B1 * 9/2001 Lin ..... 439/607
6,474,999 B1 11/2002 Givens et al.
6,764,343 B2 * 7/2004 Ferentz ..... 439/620
6,776,651 B1 * 8/2004 Liu ..... 439/620
6,786,772 B1 * 9/2004 Liu ..... 439/620

* cited by examiner

*Primary Examiner*—Tho D. Ta
(74) *Attorney, Agent, or Firm*—Wei Te Chung

(57) ABSTRACT

An electrical connector (100) mounted on a mother printed circuit board includes an insulative housing (1) defining a plug-receiving cavity (10), a conductive outer shield (2) enclosing the insulative housing, a terminal module (3) and a daughter circuit board (4) assembled into the plug-receiving cavity of the housing, and a connecting module (6) electrically connecting with the daughter circuit board. The connecting module includes a pair of first connecting contacts (61) for contacting with the daughter circuit board, a pair of second connecting contacts (62) for contacting with the mother printed circuit board and mode choke coils (65) for connecting with the first and the second connecting contacts.

6 Claims, 4 Drawing Sheets

ELECTRICAL CONNECTOR HAVING PRINTED CIRCUIT BOARD MOUNTED THEREIN

BACKGROUND OF THE INVENTION

1. Field of the Invention

This invention generally relates to an electrical connector and more particularly, to an electrical connector for high speed signal transmission.

2. Description of the Prior Art

In high speed and other telecommunication and computer applications, it is important to shield the transmitted signals. To suppress undesirable extraneous noise, an electrical connector usually incorporates signal conditioning subassemblies, such as magnetic modules. A conventional connector assembly generally provides an insulative housing, a plurality of conductive contacts, a daughter circuit board and mounting terminals for mounting the connector assembly on a mother printed circuit board, as is disclosed in U.S. Pat. No. 5,069,641. In this patent, the conductive contacts are soldered to upper circuit traces of the daughter circuit board. The mounting terminals electrically connect with lower circuit traces of the daughter circuit board. The daughter circuit board carries a plurality of magnetic modules electrically connecting with middle circuit traces thereof. Therefore, a continuous electrical connection among the conductive contacts, the magnetic modules and the mounting terminals is established through the circuit traces of the daughter circuit board. However, too many electrical traces are formed on the daughter circuit board, resulting in complexity of the daughter circuit board. In addition, the conductive contacts, the terminals and the magnetic modules are all mounted on the daughter circuit board, which inevitably increases the density of components positioned on the daughter circuit board and complicates the manufacturing process and the assembly process of the daughter circuit board. Furthermore, the daughter circuit board has too many components mounted thereon and occupies a relatively large space in the conventional connector assembly.

The present invention is directed to solving the above problems by a connecting module for receiving mode choke coils and mounting terminals.

BRIEF SUMMARY OF THE INVENTION

It is an object of the present invention to provide an electrical connector which has a simple structure and can be easily manufactured.

In order to attain the object above, an electrical connector according to the present invention comprises an insulative housing defining a plug-receiving cavity, a conductive outer shield enclosing the insulative housing, a terminal module having a plurality of conductive terminals, a daughter circuit board electrically connecting the terminal module and a connecting module abutting against a rear surface of the insulative housing for electrically connected with the daughter circuit board. The daughter circuit board and the terminal module are unitarily mounted in the plug-receiving cavity of the insulative housing. The conductive terminals of the terminal module have a plurality of contact sections extending into the plug-receiving cavity of the insulative housing. The connecting modules includes a plurality of first connecting contacts for electrically contacting with the daughter circuit board, a plurality of second connecting contacts for electrically contacting with a mother printed circuit board and a plurality of mode choke coils for connecting with the first and the second contacts. In the present invention, mode choke coils and the second connecting contacts for electrically contacting with the mother circuit board are all carried by the connecting module stead of by the daughter circuit board, thereby decreasing the density of components positioned on the daughter circuit board and simplifying the manufacturing process of the daughter circuit board. Therefore, the electrical connector can be conveniently manufactured and be easily assembled.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
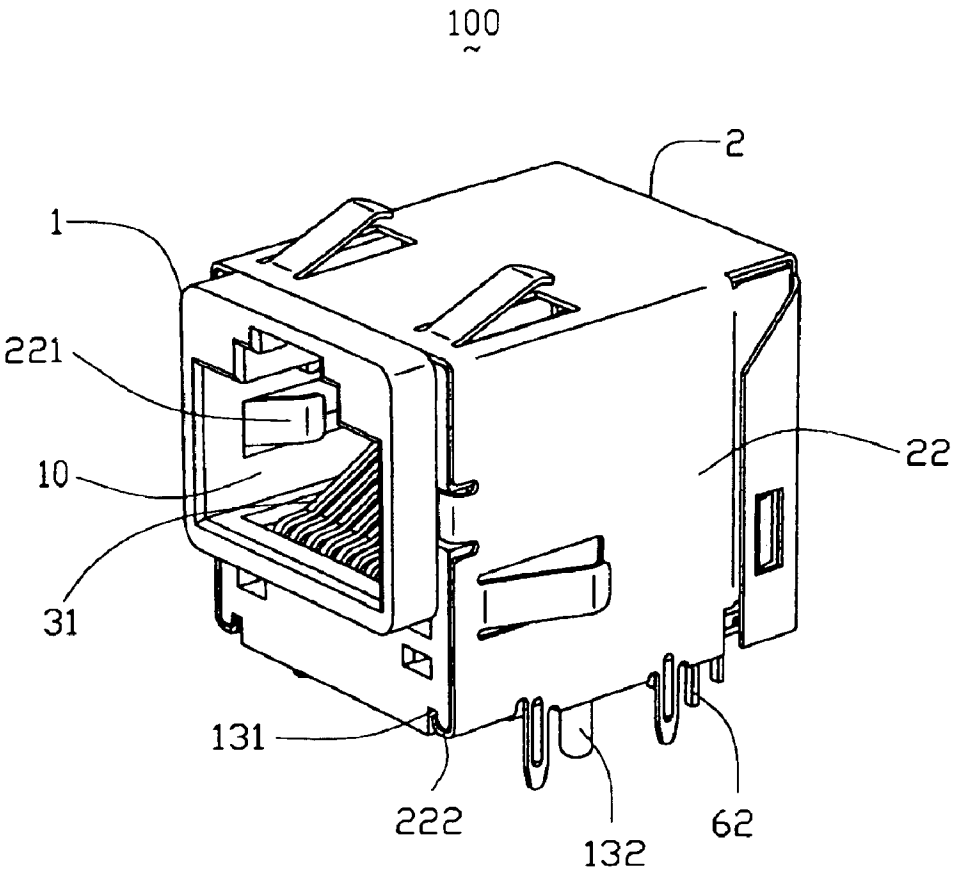
FIG. 1 is a perspective view of an electrical connector according to the present invention.
Figure 2:
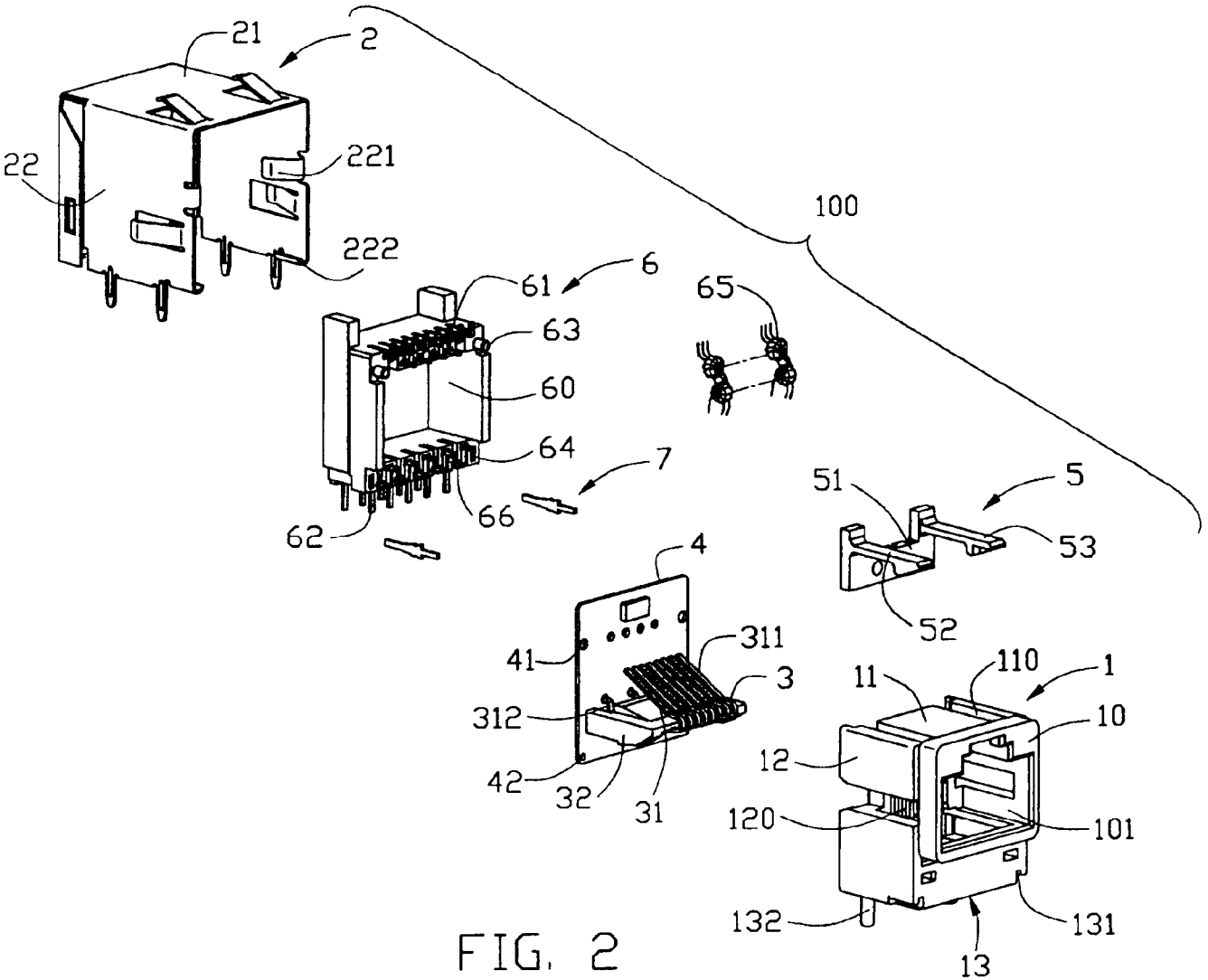
FIG. 2 is an exploded view of FIG. 1.

Referring to FIG. 2, an electrical connector 100 in accordance with the present invention to be mounted on a mother printed circuit board (PCB, not shown) comprises an insulative housing 1, a conductive outer shield 2 enclosing the housing 1, a terminal module 3, a daughter circuit board 4 and a connecting module 6. The electrical connector 100 further has a pair of dowel pins 7 for securing the connecting module 6 on the daughter circuit board 4. The electrical connector 100 may optionally includes an anti-mismating device 5.

Figure 3:
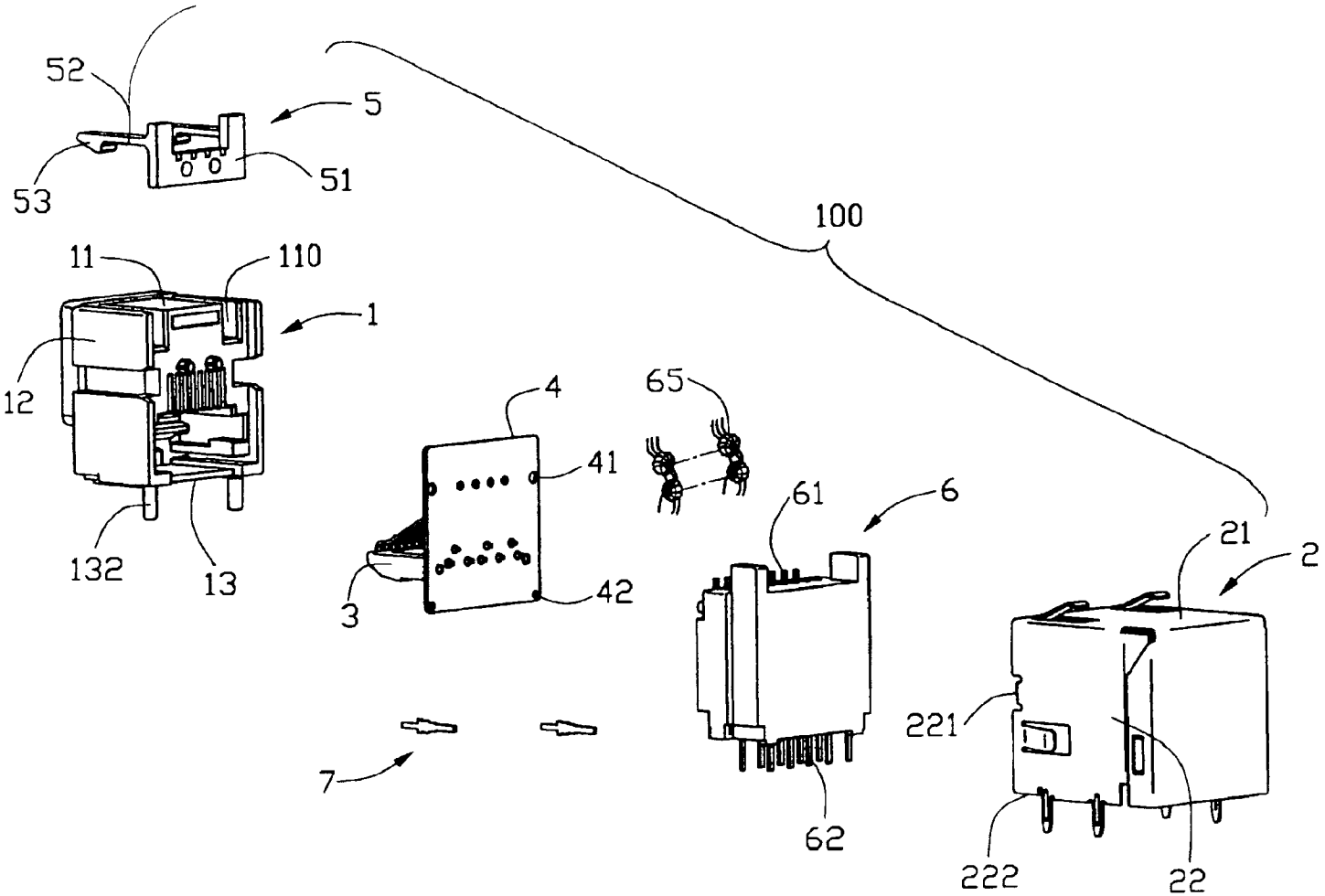
FIG. 3 is another exploded view of FIG. 1.
Figure 4:
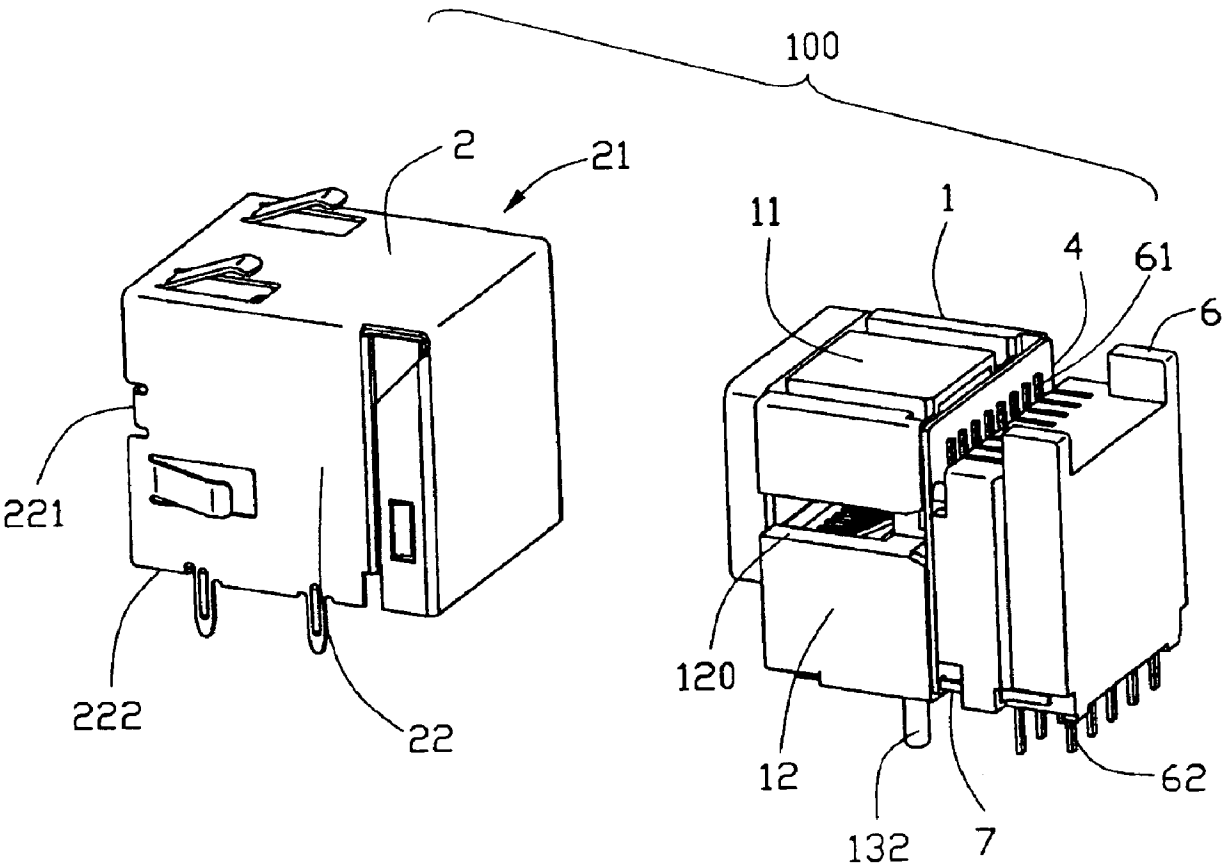
FIG. 4 is a partially assembled view of FIG. 3.

Referring to FIG. 2 in conjunction with FIG. 3, the housing 1 comprises a pair of side walls 12, a top wall 11, a bottom wall 13 and a mating face 10. The housing 1 has a plug-receiving cavity 101 extending rearwardly from a front mating face 10 of the housing 1 for receiving a complementary mating plug connector (not shown). The top wall 11 defines a pair of slots 110 in opposite sides thereof. Each side wall 12 has an opening 120 through a middle portion thereof. The bottom wall 13 has a pair of recesses 131 in opposite sides thereof, as will be described in more detail hereinafter. A pair of posts 132 project downwardly from the bottom wall 13 for engaging with counterpart positioning portions of the mother PCB.

The conductive outer shield 2 securely holds the housing 1 therein and comprises a top plate 21 and a pair of side plates 22. A pair of spring barbs 221 for entering the openings 120 of the housing 1 are backwardly and inwardly bent from the front edges of corresponding side plates 22, respectively. Each side plate 22 has a retaining portion 222 extending inwardly and upwardly from a bottom end thereof. The retaining portions 222 are substantially U-shaped for engaging with corresponding recesses 131 of the housing 1.

The terminal module 3 includes a plurality of conductive terminals 31 and a base portion 32. Each conductive terminal 31 includes a contact section 311, a soldering section 312 soldered to the daughter circuit board 4 and a retaining section (not shown) embedded in the base portion 32.

The daughter circuit board 4 comprises an array of electrical traces (not shown), and a pair of first and second mounting holes 41, 42 respectively located in the upper and lower portions thereof. The daughter circuit board 4 also can position additional signal conditioning components (not shown) thereon.

The anti-mismating device 5 comprises a body portion 51, a pair of cantilevered beams 52 forwardly extending from the body portion 51 for extending into the slots 110 of the housing 1, and a pair of engaging sections 53 respectively located in front of the cantilevered beams 52.

The connecting module 6 comprises a receiving room 60, a plurality of mode choke coils 65 received in the receiving room 60, and a plurality of first and second connecting contacts 61, 62 respectively located on upper and lower portions thereof. The first connecting contacts 61 are electrically connected with the second connecting contacts 62 by the mode choke coils 65. It should be understood that the connecting manner among the connecting contacts 61, 62 and the mode choke coils 65 is well known in the prior art, therefore, the connecting manner is not shown in the present invention and a detailed description thereof is omitted herefrom. The connecting module 6 has a pair of retaining sections 63 for interference fitting with the mounting holes 41 of the daughter circuit board 4 on opposite sides of the upper portion thereof. The connecting module 6 defines a pair of grooves 64 in opposite sides of lower portion thereof for receiving the dowel pins 7.

Referring to FIGS. 1–4, in assembly, firstly, the anti-mating device 5 is fixed on the top wall 11 of the housing 1. The cantilevered beams 52 of the anti-mating device 5 extend into the slots 110 of the top wall 11 of the housing 1. The engaging sections 53 of the cantilevered beams 52 extend into the plug-receiving cavity 101 of the housing 1. The body section 51 of the anti-mating device 5 abuts a rear surface of the housing 1. Secondly, the terminal module 3 is soldered to the daughter circuit board 4. The soldering sections 312 of the conductive terminals 31 are soldered to the corresponding electrical traces of the daughter circuit board 4. The terminal module 3 is received in the plug-receiving cavity 101 and the daughter circuit board 4 is mounted on the housing 1 from a rear surface of the housing 1. The connecting module 6 is assembled to a rear surface of the daughter circuit board 4. The first connecting contacts 61 of the connecting module 6 are soldered to the appropriate electrical traces of the daughter circuit board 4, with the retaining sections 63 of the connecting module 6 interference fitting in the first mounting holes 41 of the daughter circuit board 4. The dowel pins 7 extend forwardly to mate with the second mounting holes 42 of the daughter circuit board 4, thereby electrically connecting with the daughter circuit board 4. The dowel pins 7 rearwardly extend beyond the grooves 64 and electrically connect with the conductive outer shield 2. The conductive outer shield 2 forms a plurality of downwardly extending mounting legs (not labeled) for soldering to ground traces of the mother printed circuit board. Therefore, a continuous ground connection is established between the daughter circuit board 4 and the mother printed circuit board. Finally, the conductive outer shield 2 encloses the housing 1. The retaining portions 222 of the conductive outer shield 2 interfere with the recesses 131 of the housing 1. Therefore, the conductive outer shield 2 is securely mounted to the housing 1.

Comparing with prior arts, the mode choke coils 65 and the second connecting contact 62 for mounting the electrical connector 100 on the mother printed circuit board are assembled into the connecting module 6, which electrically connects with the daughter circuit board 4. The daughter circuit board 4 need not form additional circuit traces for connecting with the second connecting contacts 62 and the mode choke coils 65. Therefore, the daughter circuit board 4 has a simple structure and is easily manufactured. As a result, the assembly of the electrical connector 100 is more convenient, thereby increasing the production efficiency.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector adapted for mounting on a printed circuit board comprising:

an insulative housing defining a cavity;

a conductive outer shield substantially enclosing the housing;

a terminal module being received in the cavity of the housing and comprising a plurality of conductive terminals a daughter circuit board abutting a rear surface of the housing and electrically connecting with the terminals of the terminal module; and a connecting module comprising a plurality of first connecting contacts for connecting with the daughter circuit board, a plurality of second connecting contacts for connecting with a printed circuit board, and a plurality of mode choke coils connecting with the first and the second connecting contacts;

a dowel pin;

wherein the connecting module includes a receiving room for receiving said mode choke coils;

wherein the daughter circuit board has a first mounting hole therein, and wherein the connecting module comprises a forwardly projecting retaining section for engaging with the mounting hole of the daughter circuit board;

wherein said connecting module has a groove, and wherein said daughter circuit board has a second mounting hole, two opposite ends of said dowel pin respectively secured into the groove and the second mounting hole;

wherein said dowel pin rearwardly extends beyond the groove and electrically connects with the conductive outer shield.

2. The electrical connector according to claim 1, wherein the conductive outer shield has a pair of side plates, a spring barb backwardly and inwardly bending from a front edge of the side plate and a retaining portion inwardly and upwardly extending from a bottom end of the side plate.

3. The electrical connector according to claim 2, wherein the housing comprises a side wall having an opening for receiving the spring tabs of the conductive outer shielding.

4. The electrical connector according to claim 2, wherein the insulative housing includes a bottom wall having a recess for interference fitting with the retaining portion of the conductive outer shield.

5. An electrical connector adapted for mounting on a printed circuit board comprising:

an insulative housing defining a mating direction;

a plurality of conductive terminals disposed in the housing;

a vertical daughter circuit board extending perpendicular to said mating direction and abutting a rear surface of the housing and electrically connecting with the terminals; and a connecting module comprising a plurality of upper connecting contacts for connecting with the daughter circuit board, a plurality of lower connecting contacts for connecting with a horizontal external printed circuit board on which the housing is seated, and a plurality of mode choke coils connecting with the upper and the lower connecting contacts;

wherein the daughter circuit board has a mounting hole therein, and the connecting module comprises a forwardly projecting retaining section for engaging with the mounting hole of the daughter circuit board.

6. An electrical connector adapted for mounting on a printed circuit board comprising:

an insulative housing defining a cavity;

a conductive outer shield substantially enclosing the housing;

a terminal module being received in the cavity of the housing and comprising a plurality of conductive terminals;

a daughter circuit board abutting a rear surface of the housing and electrically connecting with the terminals of the terminal module; and a connecting module comprising a plurality of first connecting contacts for connecting with the daughter circuit board, a plurality of second connecting contacts for connecting with a printed circuit board, and a plurality of mode choke coils connecting with the first and the second connecting contacts; wherein the connecting module includes a receiving room for receiving said mode choke coils; and the daughter circuit board bas a mounting hole therein, and the connecting module comprises a forwardly projecting retaining section for engaging with the mounting hole of the daughter circuit board.

* * * * *